US006350507B1

(12) United States Patent
Iwamoto et al.

(10) Patent No.: US 6,350,507 B1
(45) Date of Patent: Feb. 26, 2002

(54) RECORDING SHEET FOR INK JET PRINTER

(75) Inventors: Kiyoshi Iwamoto; Shinitiro Kobayashi; Takeshi Yoshimoto; Takayuki Ishikawa; Nobuhiro Kubota, all of Shizuoka; Jun Sugiyama, Nagano; Hiroyuki Onishi, Nagano; Yukari Sano, Nagano, all of (JP)

(73) Assignees: Tomoegawa Paper Co., Ltd.; Seiko Epson Corporation, both of Tokyo (JP)

( * ) Notice: Subject to any disclaimer, the term of this patent is extended or adjusted under 35 U.S.C. 154(b) by 0 days.

(21) Appl. No.: 09/270,323

(22) Filed: Mar. 16, 1999

(30) Foreign Application Priority Data

Mar. 17, 1998 (JP) ..... 10-087968
Mar. 11, 1999 (JP) ..... 11-064319

(51) Int. Cl.[7] ..... B41M 5/00

(52) U.S. Cl. ..... 428/195; 428/409

(58) Field of Search ..... 428/195, 331

(56) References Cited

U.S. PATENT DOCUMENTS

| | | | | |
|---|---|---|---|---|
| 4,740,420 A | | 4/1988 | Akutsu et al. | 428/341 |
| 5,576,088 A | * | 11/1996 | Ogawa et al. | 428/327 |
| 5,916,673 A | | 6/1999 | Fryberg et al. | 428/328 |

FOREIGN PATENT DOCUMENTS

| | | | |
|---|---|---|---|
| EP | 0 199 874 | | 11/1986 |
| EP | 0 736 392 | | 9/1999 |
| JP | 59-78885 | | 5/1984 |
| JP | 61-63477 | | 4/1986 |
| JP | 4-15745 | | 1/1992 |
| JP | 06-183134 | * | 7/1994 |
| JP | 8-169177 | | 2/1996 |
| WO | WO 99/06219 | | 2/1999 |

* cited by examiner

*Primary Examiner*—Bruce H. Hess
(74) *Attorney, Agent, or Firm*—Scully, Scott, Murphy & Presser

(57) ABSTRACT

The present invention provides a superior recording sheet for ink jet printers which can completely satisfy property requirements such as light resistance of the printing images. The recording sheet for an ink jet printer includes a water-soluble divalent or greater metallic salt, so that properties such as light resistance are improved very effectively.

18 Claims, No Drawings

RECORDING SHEET FOR INK JET PRINTER

BACKGROUND OF THE INVENTION

The present invention relates to a recording paper, and in particular, relates to a recording sheet for an ink jet printer, in which printing density is high and vivid; ink absorptivity is superior; light resistance, shelf-life in a room, yellow stain prevention and water resistance are excellent; fading and changing of color tone in direct sunlight can be avoided; and ink is quickly absorbed, thereby satisfying high speed printing technique requirements in the future.

The use ink jet printers is further increasing in recent years since they have characteristics such as vividness of recording images, quiet operation, ease of coloring, and the like. In order to prevent the jet nozzle from being blocked due to drying of ink, an ink which is difficult to dry must be used in the ink jet printer. As ink having this property, water-soluble ink which is dissolved or dispersed with adhesive, dye, solvent, additives, or the like, in water, is generally employed. However, a letter or an image formed on the recording sheet by employing the water-soluble ink is inferior to that of printed matter or silver halide photographs due to the use of pigment-type inks, from the viewpoint of light resistance, shelf-life in a room, water resistance, and resistance to direct sunlight.

In recent years, as ink jet printers become less expensive and high vividness and colorfulness of the printing image is anticipated, the requirements for various properties such as light resistance are gradually becoming severe. Therefore, completely satisfying these various requirements such as light resistance is an essential goal for recording sheets for ink jet printers.

In consideration of this present situation, improvement of the light resistance of recording sheets for ink jet printers is being studied. Many patent applications, for example, typified by Japanese Patent Publication No. 4(92)-15745, proposes adding metallic compounds such as magnesium oxide, magnesium carbonate, calcium oxide, calcium carbonate, or the like to improve light resistance. However, it has been confirmed that an improvement in light resistance by merely adding these metallic compounds is not sufficient and a drawback is that a decrease in vividness of images results. Additionally, with regard to conventional methods of improving yellow stain prevention of recording sheets for ink jet printers, many patents, for example, typified by Japanese Patent Unexamined Publication (Kokai) No. 8(96)-169177, are applied for. However, these improvements are not yet sufficient and are not put to practical use. Furthermore, with regard to light resistance, resistance to the room light has been studied; however, preventive methods for fading and changing of color tone in direct sunlight have not been researched sufficiently.

Therefore, an object of the present invention is to provide a superior recording sheet for an ink jet printer which sufficiently satisfies various property requirements such as light resistance of images.

SUMMARY OF THE INVENTION

According to the results that the inventors have derived from various studies with regard to a recording sheet for an ink jet printer, the various properties, such as the light resistance of images, are improved very effectively by including a specific salt in an ink receiving layer, and have thereby attained the present invention. In other words, the present invention provides a recording sheet for an ink jet printer including a water-soluble divalent or greater metallic salt. In the following, the preferred embodiments according to the present invention will be explained in detail.

The recording sheet for an ink jet printer according to the present invention is a lamination in which is provided at least one ink receiving layer on at least one surface of a base material by a providing means such as a coating method, or the like. The ink receiving layer may be provided as two layers or more. In the following, materials which consist of a base material and an ink receiving layer will be explained.

(1) Base Material

As a base material provided for coating an ink receiving layer and a back coat layer according to the present invention, a base paper which is mixed wood pulp such as chemical pulp such as LBKP, NBKP, or the like; mechanical pulp such as GP, POW, RMP, TMP, CTMP, CMP, CGP, or the like; recycled pulp such as DIP, or the like; etc.; or synthetic fiber pulp such as polyethylene fiber, or the like, as a primary component, with pigment and any type of additive which is usually employed in paper such as sizing agent, yield improving agent, strength agent, or the like, alone or in combination, as necessary, and produced by using any type of apparatus such as a fourdrinier paper machine, cylinder paper machine, twin wire paper machine, or the like; can be preferably employed. In addition, a base paper provided with starch, polyvinyl alcohol, or the like using a size press; a base paper provided with an anchor coat layer; a coated paper such as art paper, coated paper, cast coat paper, or the like, on which is provided with a coat layer on these base papers, can be preferably employed. These base papers and coated papers may provide an ink receiving layer directly, and in order to control flattening of the paper, a calender apparatus may be used such as a machine calender, TG calender, soft calender, or the like, before coating the ink receiving layer.

As a base material, a polyolefin resin layer may be provided on the surface of the above-described base paper, and synthetic resin such as polyethylene, polypropylene, polyester, nylon, rayon, polyurethane, or the like; film material comprised of mixture with these; and fiber-formed sheets of these synthetic resins may be employed.

(2) Ink Receiving Layer (A) Pigment

In an ink receiving layer according to the present invention, generally used pigments which are insoluble or slightly soluble in water can be employed alone or in combination. For example, a white inorganic pigment such as precipitated calcium carbonate, heavy calcium carbonate, kaolin, talc, calcium sulfate, barium sulfate, titanium dioxide, zinc oxide, zinc sulfide, zinc carbonate, satin white, aluminum silicate, diatomite, calcium silicate, magnesium silicate, synthetic amorphous silica, colloidal silica, colloidal alumina, pseudo-boehmite, aluminum hydroxide, alumina, lithopone, zeolite, hydrolytic halloysite, magnesium carbonate, magnesium hydroxide, or the like; an organic pigment such as styrene-type plastic pigment, acrylic-type plastic pigment, polyethylene, microcapsules, urea resin, melamine resin, or the like, etc., can be employed.

Of these pigments, as white pigment which is a primary component contained in an ink receiving layer, porous inorganic pigment is preferable since drying properties and absorptivity of an ink for an ink jet printer is excellent. For example, porous synthetic amorphous silica, porous magnesium carbonate, porous alumina, or the like, are preferably employed. Of these, since both printing quality and shelf-life (shelf-life in a room or in direct sunlight) are satisfied in the present invention, the precipitation type or the gel type of porous synthetic amorphous silica with a specific surface of about 200 to 600 g/m$^2$ can be preferably employed.

(B) Binder Resin

As binder resin contained in an ink receiving layer according to the present invention, polyvinyl alcohol, silyl modified polyvinyl alcohol, vinyl acetate, oxidized starch, etherificated starch, casein, gelatin, soybean protein; cellulosic derivative such as carboxymethyl cellulose, hydroxyethyl cellulose, or the like; conjugate diene type copolymer latex such as maleic anhydride resin, styrene-butadiene type copolymer, methylmethacrylate-butadiene copolymer, or the like; acrylic type polymer latex such as (metha)acrylic acid ester polymer, (metha)acrylic acid ester copolymer, or the like; vinylic type polymer latex such as ethylene-vinylacetate copolymer, or the like; functional group modified polymer latex comprised of monomer including functional groups such as carboxy group, or the like of all types of these polymers; water-soluble adhesive consisting of thermosetting synthetic resin such as melamine resin, urea resin, or the like; synthetic resin type adhesive such as polymethylmethacrylate, polyurethan resin, unsaturated polyester resin, vinylchloride-vinylacetate copolymer, polyvinylbutyral, alkyd resin, or the like, can be preferably employed. These can be employed alone or in combination.

The compounding ratio of the pigment to the binder resin in the ink receiving layer is preferably 1/1 to 1/15, and is more preferably 1/2 to 1/10.

(C) Water-Soluble Divalent or Greater Metallic Salt

A general ink receiving layer of a recording sheet for an ink jet printer is comprised of the above-described pigment and binder resin as primary components; however, the main feature of the present invention is that a water-soluble divalent or greater metallic salt is additionally included in an ink receiving layer. In this case, "water-soluble" means that 25 g or more of inorganic metallic salt by anhydrous weight is dissolved in 100 g of saturated solution, when saturated solution with metallic salt employing water at 20° C. as solvent is prepared. The "divalent or greater metallic salt" means that a divalent or greater metallic cation formed when the salt is dissolved and electrolyzed in water or the like. As a metallic salt, a water-soluble divalent or greater metallic salt can be employed in an appropriate ratio. Particularly, halogenide or hexafluorosilicate of typical elements such as magnesium, calcium, strontium, barium, gallium, indium, thallium, germanium, tin, lead, bismuth, or the like; inorganic metallic salts such as sulfate, thiosulfate, phosphate, chlorate, nitrate, or the like have good solubility and excellent improvement. Water-soluble salts of organic acid can be also employed. Since these salts scarcely cause light scattering which caused by insoluble salt, etc., in the ink receiving layer or the like, there is no problem in that the color image is somber in printing, whereby these are preferably employed.

For example, magnesium chloride, calcium chloride, barium chloride, tin chloride, lead chloride, magnesium sulfate, calcium sulfate, magnesium chlorate, magnesium phosphate, magnesium nitrate, barium nitrate, calcium nitrate, or the like, can be preferably employed. The metallic salt content to total solid of the ink receiving layer is preferably in any ratio, is more preferably ranging from 1.0 to 40.0% by weight, and is most preferably ranging from 5.0 to 20.0% by weight. In the case in which the content is less than 1.0% by weight, sufficient effects of light resistance of images and various properties are not confirmed. In the case in which an amount of more than 40.0% by weight is added, although light resistance and the various properties are sufficiently improved, further improvement is not expected. Moreover, water resistance, moisture resistance or strength of ink receiving layer may decrease and control of printing quality of ink jet images may be difficult. In order to obtain vividly printed images, suitable ranges of these contents to the pigment in the ink receiving layer are preferably 5.0 to 40.0% by weight, and are more preferably 10.0 to 20.0% by weight. In order to maintain superior vividness, the coating weight of the metallic salt is preferably 0.2 to 10.0 g/m$^2$ by weight.

In addition, these metallic salts may be employed by coating on the base material so that the coating weight of the salt is about 0.2 to 20.0 g/m$^2$, or by adding in the base material so that the concentration of the salt is about 0.5 to 20.0% by weight.

(D) Other Additives

Furthermore, as other additives added to the ink receiving layer, cationic dye fixing agent, pigment dispersing agent, thickener, fluidity improving agent, defoaming agent, foam inhibitor, surface lubricant, foaming agent, penetrating agent, color dye, color pigment, fluorescent brightening agent, UV absorber, antioxidant, antiseptics, water resistant agent, hardening agent, or the like, can be blended in an appropriate ratio, as necessary.

Of these additives, in particular, the cationic dye fixing agent may cooperate with the water-soluble divalent or greater metallic salt in improvement of the light resistance. In order to obtain light resistance and water resistance and to improve these effectiveness, the solid content ratio of the water-soluble divalent or greater metallic salt with respect to the cationic dye fixing agent in the ink receiving layer is preferably 1/4 to 4/1, and is more preferably 1/1 to 3/2.

The composition of the ink receiving layer according to the present invention is not limited to the above-described materials. In order to satisfy various properties such as light resistance and to solve the productive problems such as adhesion to the base material, powdering of the layer (pigments fall off in the layer) in the cutting process, or the like, the solid content ratio of each material in the ink receiving layer is most preferably 40.0 to 60.0% of pigment (preferably silica and/or alumina) by weight, 20.0 to 40.0% of binder resin by weight, and 1.0 to 40.0% of water-soluble divalent or greater metallic salt by weight.

DETAILED DESCRIPTION OF THE PREFERRED EMBODIMENTS

The ink receiving layer is formed on a supporting material by coating the coating material which was prepared by dissolving or dispersing in a suitable solvent, such as water or alcohol, completely dissolving divalent metallic salt, or the like, using various kinds of apparatus such as a blade coater, roll coater, air knife coater, bar coater, rod blade coater, size press, or the like on-machine or off-machine as appropriate. The coating weight of the ink receiving layer in the one layer type is preferably 5.0 to 30.0 g/m$^2$, and is more preferably 5.0 to 20.0 g/m$^2$. In the case of the two layer type in which is provided the first ink receiving layer on a base material and in which is provided the second ink receiving layer on the first ink receiving layer, the coating weight of the first ink receiving layer is preferably 5.0 to 30.0 g/m$^2$, and is more preferably 5.0 to 20.0 g/m$^2$.

In addition, the coating weight of the second ink receiving layer is preferably 5.0 to 15.0 g/m$^2$, and is more preferably 5.0 to 10.0 g/m$^2$. In the case in which the coating weight is less than in the above range, excellent ink absorptivity or fixativity is seldom obtained. In the case in which it is more than in the above range, the problems such as powdering of the layer, decrease of the productivity, increase in cost or the like is caused. In particular, in the case in which the coating weight of the second ink receiving layer is more than 15 g/m$^2$, it is difficult for the ink to pass through to the second ink receiving layer, thereby causing blurring of ink, so that vividness of images is impaired. In this way, it is preferred that the coating weight of the ink receiving layer be controlled according to the number of the provided ink receiving layers. In the case in which two or more ink receiving layers are provided, the metallic salts may be contained in any of the ink receiving layers, or may be contained in some of the ink receiving layers. In the case in which the metallic salts are contained in some ink receiving layers, in order to reduce the concentration difference between the layers, the content of the metallic salts contained in the layers is preferably the same ratio.

The coated ink receiving layer may be finished, using a calender such as a machine calender, TG calender, super calender, soft calender, or the like.

The recording sheet for an ink jet printer according to the present invention is constructed as described above, and even the construction which provided only the ink receiving layer has sufficient properties. Additionally, a glossiness adjusting layer may be provided on a surface of an ink receiving layer. This glossiness adjusting layer preferably has the property that glossiness, by measuring the 60° specular glossiness test according to the Japanese Industrial Standard Z8741, is 10 or more. As material of a glossiness adjusting layer, mixture materials of binder resin and pigment employed in an ink receiving layer may be employed as a coating solution. According to one method of providing the glossiness adjusting layer on the ink receiving layer in addition to the general coating method, for example, the coating solution is coated on base material which is inferior in adhesive property (for example, polyolefin resin film, ethylene tetrafluoride resin film, separatable silicone processed film, or the like); this coating surface is adhered to the surface of the ink receiving layer; after being dried, the base material is taken off; and the glossiness adjusting layer is formed. In order to maintain glossiness, it is preferable that the compounding ratio of the binding resin to the pigment in the glossiness adjusting layer be 5.0 to 50.0% by weight, and is more preferably 5.0 to 30.0% by weight. Weighting capacity, in which the glossiness adjusting layer exhibit excellent glossiness without impairing the function of the ink receiving layer, is preferably 3.0 to 25.0 g/m$^2$, and is more preferably 5.0 to 15.0 g/m$^2$.

The glossiness adjusting layer provided on the ink receiving layer according to the present invention preferably includes colloidal silica as a pigment component. The glossiness can be optionally adjusted by employing the colloidal silica which consists of different sized particles in an appropriate ratio. This glossiness adjusting layer can be adjusted by choosing the composition in an appropriate ratio so that the glossiness of the printed portion can be higher than that of the non printed portion, or can be conversely lower than it.

EXAMPLES

The effects according to the present invention will be shown by explaining the Examples and the Comparative Examples. As base material, wood free paper having the basic weight of 90.0 g/m$^2$ was employed in each Example and in each Comparative Example. The coating materials were obtained by dissolving and dispersing the below-described materials in water and an ink receiving layer was provided by coating the coating materials for the ink receiving layer on one surface of this base material and drying. A coating material for a glossiness adjusting layer was coated on a polyethylene film, which was laminated on the above-described ink receiving layer. This laminate structure was dried and the polyethylene film was separated (film transferring method). Thus, a recording sheet for an ink jet printer was formed. With regard to Example 1, 12, 21 and 22, the recording sheets for an ink jet printer having a glossiness adjusting layer with low glossiness were also formed by the ordinary coating and drying method instead of the film transferring method. In the Examples, the weight ratio of dried solid was used. Unless otherwise noted, the coating volumes of the ink receiving layer and the glossiness adjusting layer were 10.0 g/m$^2$.

Example 1

[Ink Receiving Layer]

Binder Resin Itaconic acid modified PVA, 39.0% by weight (trade name: Kuraray-Poval KL-318K; produced by KURARAY CO., LTD.)

White Pigment Silica, 39.0% by weight (trade name: Mizukasil P78D; produced by Mizusawa Industrial Chemicals Ltd.)

Cationic dye fixing agent, 19.5% by weight (trade name: Polyfix550; produced by Showa Highpolymer Co., Ltd.)

Water-soluble Divalent or Greater Metallic Salt

Magnesium chloride, 2.5% by weight (trade name: Magnesium Chloride S; produced by Tomita Pharmaceutical Co., Ltd.)

[Glossiness Adjusting Layer]

Binder Resin

Maleic acid modified PVA, 10.0% by weight (trade name: Gohsenal T-350; produced by The Nippon Synthetic Chemical Industry Co., Ltd.)

Colloidal Silica, 90.0% by weight (trade name: Snowtex UP; produced by Nissan Chemical Industries, Ltd.)

Example 2

The recording sheet for an ink jet printer was formed consisting of binder resin, white pigment, cationic dye fixing agent in ratios similar to the ratios of the ink receiving layer in Example 1, and magnesium chloride having total solid concentration in the ink receiving layer is 10.0% by weight, in a same manner as Example 1.

Example 3

The recording sheet for an ink jet printer was formed consisting of binder resin, white pigment, cationic dye fixing agent in ratios similar to the ratios of the ink receiving layer in Example 1, and magnesium chloride having total solid concentration in the ink receiving layer is 20.0% by weight, in a same manner as Example 1.

Example 4

The recording sheet for an ink jet printer was formed by providing an ink receiving layer containing no magnesium chloride (binder resin, white pigment and cationic dye fixing agent were in ratios similar to the ratios in Example 1) on an ink receiving layer of Example 3 containing 20.0% magnesium chloride by weight, and providing an glossiness adjusting layer in a same manner as Example 1.

Example 5

In contrast to the coating order of the ink receiving layer of Example 4, the recording sheet for an ink jet printer was formed by providing an ink receiving layer containing 20.0% magnesium chloride by weight on an ink receiving layer containing no magnesium chloride.

Example 6

The recording sheet for an ink jet printer was formed by further providing an ink receiving layer containing 10.0% magnesium chloride by weight on an ink receiving layer of Example 2 containing 10.0% magnesium chloride by weight, and providing an glossiness adjusting layer in a same manner as Example 1.

Example 7

The recording sheet for an ink jet printer was formed by providing no glossiness adjusting layer on an ink receiving layer of Example 3.

Example 8

The recording sheet for an ink jet printer was formed consisting of binder resin, white pigment, cationic dye fixing agent in ratios similar to the ratios of the ink receiving layer in Example 1, and calcium chloride (trade name: Calcium Chloride H; produced by Tomita Pharmaceutical Co., Ltd.) so that total solid concentration in the ink receiving layer is 20.0% by weight, in a same manner as Example 1.

Example 9

The recording sheet for an ink jet printer was formed consisting of binder resin, white pigment, cationic dye fixing agent in ratios similar to the ratios of the ink receiving layer in Example 1, and magnesium sulfate having total solid concentration in the ink receiving layer is 20.0% by weight, in a same manner as Example 1.

Example 10

[Ink Receiving Layer]

Binder Resin

Itaconic acid modified PVA, 27.5% by weight (trade name: Kuraray-Poval KL-318K; produced by KURARAY CO., LTD.)

White Pigment

Silica, 47.5% by weight (trade name: Mizukasil P78D; produced by Mizusawa Industrial Chemicals Ltd.)

Cationic dye fixing agent, 5.0% by weight (trade name: Polyfix550; produced by Showa Highpolymer Co., Ltd.)

Water-soluble Divalent or Greater Metallic Salt

Magnesium chloride, 20.0% by weight (trade name: Magnesium Chloride S; produced by Tomita Pharmaceutical Co., Ltd.)

[Glossiness Adjusting Layer]

Binder Resin

Maleic acid modified PVA, 10.0% by weight (trade name: Gohsenal T-350; produced by The Nippon Synthetic Chemical Industry Co., Ltd.)

Colloidal Silica, 45.0% by weight (trade name: Snowtex UP; produced by Nissan Chemical Industries, Ltd.) and 45.0% by weight (trade name: Snowtex XL; produced by Nissan Chemical Industries, Ltd.)

Example 11

The recording sheet for an ink jet printer was formed consisting of binder resin, white pigment, magnesium chloride in ratios similar to the ratios of the ink receiving layer in Example 10, and cationic dye fixing agent having total solid concentration in the ink receiving layer is 10.0% by weight, in a same manner as Example 10.

Example 12

The recording sheet for an ink jet printer was formed consisting of binder resin, white pigment, magnesium chloride in ratios similar to the ratios of the ink receiving layer in Example 10, and cationic dye fixing agent having total solid concentration in the ink receiving layer is 20.0% by weight, in a same manner as Example 10.

Example 13

The recording sheet for an ink jet printer was formed consisting of binder resin, white pigment, cationic dye fixing agent in ratios similar to the ratios of the ink receiving layer in Example 10, and magnesium chloride having total solid concentration in the ink receiving layer is 40.0% by weight, in a same manner as Example 10.

Example 14

The recording sheet for an ink jet printer was formed by providing an ink receiving layer containing no magnesium chloride (binder resin, white pigment and cationic dye fixing agent were in ratios similar to the ratios in Example 12) on an ink receiving layer of Example 12 containing 20.0% magnesium chloride by weight, and providing an glossiness adjusting layer in a same manner as Example 10.

Example 15

In contrast to the coating order of the ink receiving layer of Example 14, the recording sheet for an ink jet printer was formed by providing an ink receiving layer containing 20.0% magnesium chloride by weight on an ink receiving layer containing no magnesium chloride.

Example 16

The recording sheet for an ink jet printer was formed by further providing an ink receiving layer containing 20.0% magnesium chloride by weight on an ink receiving layer of Example 12 containing 20.0% magnesium chloride by weight, and providing an glossiness adjusting layer in a same manner as Example 10.

Example 17

The recording sheet for an ink jet printer was formed consisting of binder resin, white pigment, cationic dye fixing agent in ratios similar to the ratios of the ink receiving layer in Example 12, using alumina (trade name: fine-grained Alumina A31; produced by Nippon Light Metal Co., Ltd.) instead of silica in Example 12 as white pigment, and providing an glossiness adjusting layer in a same manner as Example 10.

Example 18

The recording sheet for an ink jet printer was formed by providing no glossiness adjusting layer on an ink receiving layer of Example 12.

Example 19

The recording sheet for an ink jet printer was formed consisting of binder resin, white pigment, cationic dye fixing agent in ratios similar to the ratios of the ink receiving layer in Example 12, and calcium chloride (trade name: Calcium Chloride H; produced by Tomita Pharmaceutical Co., Ltd.) so that total solid concentration in the ink receiving layer is 20.0% by weight, in a same manner as Example 10.

Example 20

The recording sheet for an ink jet printer was formed consisting of binder resin, white pigment, cationic dye fixing agent in ratios similar to the ratios of the ink receiving layer in Example 12, and magnesium sulfate having total solid concentration in the ink receiving layer is 20.0% by weight, in a same manner as Example 10.

Example 21

The recording sheet for an ink jet printer was formed by providing an ink receiving layer in ratios similar to the ratios of the ink receiving layer in Example 12, and providing a glossiness adjusting layer consisting of colloidal silica, 54.0% by weight (trade name: Snowtex UP) and 36.0% by weight (trade name: Snowtex XL), binder resin.

Example 22

The recording sheet for an ink jet printer was formed by providing an ink receiving layer in ratios similar to the ratios of the ink receiving layer in Example 12, and providing a glossiness adjusting layer consisting of colloidal silica, 27.0% by weight (trade name: Snowtex UP) and 63.0% by weight (trade name: Snowtex XL), binder resin.

Example 23

The recording sheet for an ink jet printer was formed consisting of binder resin, white pigment, magnesium chloride in ratios similar to the ratios of the ink receiving layer in Example 10, so that cationic dye fixing agent is not consisted in the ink receiving layer, in a same manner as Example 10.

Example 24

[Ink Receiving Layer]

Binder Resin

Itaconic acid modified PVA, 20.0% by weight (trade name: Kuraray-Poval KL-318K; produced by KURARAY CO., LTD.)

White Pigment

Silica, 20.0% by weight (trade name: Mizukasil P78D; produced by Mizusawa Industrial Chemicals Ltd.)

Cationic dye fixing agent, 10.0% by weight (trade name: Polyfix550; produced by Showa Highpolymer Co., Ltd.)

Water-soluble Divalent or Greater Matallic Salt

Magnesium chloride, 50.0% by weight (trade name: Magnesium Chloride S; produced by Tomita Pharmaceutical Co., Ltd.)

Glossiness adjusting layer was formed in a same manner as Example 10 and the recording sheet for an ink jet printer was formed.

Example 25

[Ink Receiving Layer]

Binder Resin

Itaconic acid modified PVA, 10.0% by weight (trade name: Kuraray-Poval KL-318K; produced by KURARAY CO., LTD.)

White Pigment

Silica, 30.0% by weight (trade name: Mizukasil P78D; produced by Mizusawa Industrial Chemicals Ltd.)

Cationic dye fixing agent, 10.0% by weight (trade name: Polyfix550; produced by Showa Highpolymer Co., Ltd.)

Water-soluble Divalent or Greater Matallic Salt

Magnesium chloride, 50.0% by weight (trade name: Magnesium Chloride S; produced by Tomita Pharmaceutical Co., Ltd.)

Glossiness adjusting layer was formed in a same manner as Example 10 and the recording sheet for an ink jet printer was formed.

Comparative Example 1

The recording sheet for an ink jet printer was formed consisting of binder resin, white pigment, cationic dye fixing agent in ratios similar to the ratios of the ink receiving layer in Example 1, in a same manner as Example 1. Magnesium chloride was not contained.

Comparative Example 2

The recording sheet for an ink jet printer was formed consisting of binder resin, white pigment, cationic dye fixing agent in ratios similar to the ratios of the ink receiving layer in Example 1, and sodium chloride, as a water-soluble monovalent metallic salt, so that total solid concentration in the ink receiving layer is 20.0% by weight, in a same manner as Example 1.

Comparative Example 3

The recording sheet for an ink jet printer was formed consisting of binder resin, white pigment, cationic dye fixing agent in ratios similar to the ratios of the ink receiving layer in Example 1, and potassium chloride, as a water-soluble monovalent metallic salt, so that total solid concentration in the ink receiving layer is 20.0% by weight, in a same manner as Example 1.

Comparative Example 4

The recording sheet for an ink jet printer was formed consisting of binder resin, white pigment, cationic dye fixing agent in ratios similar to the ratios of the ink receiving layer in Example 1, and sodium sulfate, as a slightly water-soluble monovalent metallic salt, so that total solid concentration in the ink receiving layer is 20.0% by weight, in a same manner as Example 1.

Comparative Example 5

The recording sheet for an ink jet printer was formed consisting of binder resin, white pigment, cationic dye fixing agent in ratios similar to the ratios of the ink receiving layer in Example 1, and calcium hydroxide, as a slightly water-soluble divalent metallic salt, so that total solid concentration in the ink receiving layer is 20.0% by weight, in a same manner as Example 1.

Comparative Example 6

The recording sheet for an ink jet printer was formed consisting of binder resin, white pigment, cationic dye fixing agent in ratios similar to the ratios of the ink receiving layer in Example 12, in a same manner as Example 10, so that magnesium chloride is not contained.

Comparative Example 7

The recording sheet for an ink jet printer was formed consisting of binder resin, white pigment, cationic dye fixing agent in ratios similar to the ratios of the ink receiving layer in Example 12, and sodium chloride, as a water-soluble monovalent metallic salt, so that total solid concentration in the ink receiving layer is 20.0% by weight, in a same manner as Example 10.

Comparative Example 8

The recording sheet for an ink jet printer was formed consisting of binder resin, white pigment, cationic dye fixing agent in ratios similar to the ratios of the ink receiving layer in Example 12, and sodium sulfate, as a slightly water-soluble monovalent metallic salt, so that total solid concentration in the ink receiving layer is 20.0% by weight, in a same manner as Example 10.

Comparative Example 9

The recording sheet for an ink jet printer was formed consisting of binder resin, white pigment, cationic dye fixing agent in ratios similar to the ratios of the ink receiving layer in Example 12, and calcium hydroxide, as a slightly water-soluble divalent metallic salt, so that total solid concentration in the ink receiving layer is 20.0% by weight, in a same manner as Example 10.

Subsequently, with regard to the recording sheets for an ink jet printer obtained in Examples 1 to 25 and the comparative recording sheets for an ink jet printer obtained in Comparative Example 1 to 9, the objects for evaluation such as a color patch or the like were printed on these sheets, using an ink jet printer (trade name: PM-700C; produced by Seiko Epson Corporation), thereby obtaining excellent printing images. Shelf-life in a clear file, shelf-life in a room, water resistance, ink absorptivity, image moisture resistance, ink receiving layer strength, glossiness adjusting layer strength and glossiness were evaluated by the below-described means using these printing images, and the results are shown in Table 1 and Table 2. The results of the 60° specular glossiness test is shown in Table 3.

TABLE 1

| | Light Resistance 1 | Light Resistance 2 | Light Resistance 3 | Light Resistance 4 | Shef Life in Clear File | Shef Life in Room | Water Resistance | Ink Absorptivity | Image Moisture Resistance | Ink Receiving Layer Strength | Glossiness Adjusting Layer Strength |
|---|---|---|---|---|---|---|---|---|---|---|---|
| Example 1 | B | B | B | B | B | A | A | A | A | A | A |
| Example 2 | A | A | A | A | A | A | A | A | A | A | A |
| Example 3 | A | A | A | A | A | A | A | A | A | A | A |
| Example 4 | A | A | A | A | A | A | A | A | A | A | A |
| Example 5 | A | A | A | A | A | A | A | A | A | A | A |
| Example 6 | A | A | A | A | A | A | A | A | A | A | A |
| Example 7 | A | A | A | A | A | A | A | A | A | A | — |
| Example 8 | A | A | A | A | A | A | A | A | A | A | A |
| Example 9 | A | A | A | A | A | A | A | A | A | A | A |
| Example 10 | B | B | B | B | A | A | B | B | B | A | A |
| Example 11 | B | B | B | B | A | A | B | B | B | A | A |
| Example 12 | A | A | A | A | A | A | A | A | A | A | A |
| Example 13 | A | A | A | A | A | A | A | A | A | A | A |
| Example 14 | A | A | A | A | A | A | A | A | A | A | A |
| Example 15 | A | A | A | A | A | A | A | A | A | A | A |
| Example 16 | A | A | A | A | A | A | A | A | A | A | A |
| Example 17 | B | B | B | B | A | A | A | A | A | A | A |
| Example 18 | A | A | A | A | A | A | A | A | A | A | — |
| Example 19 | B | B | B | B | A | A | A | A | A | A | A |
| Example 20 | B | B | B | B | A | A | B | A | A | A | A |
| Example 21 | A | A | A | A | A | A | A | A | A | A | A |
| Example 22 | A | A | A | A | A | A | A | A | A | A | A |
| Example 23 | B | B | B | B | A | B | B | B | B | A | A |
| Example 24 | B | B | B | B | B | B | B | B | B | B | B |
| Example 25 | B | B | B | B | B | B | B | B | B | B | B |

TABLE 2

| | Light Resistance 1 | Light Resistance 2 | Light Resistance 3 | Light Resistance 4 | Shef Life in Clear File | Shef Life in Room | Water Resistance | Ink Absorptivity | Image Moisture Resistance | Ink Receiving Layer Strength | Glossiness Adjusting Layer Strength |
|---|---|---|---|---|---|---|---|---|---|---|---|
| Comparative Example 1 | C | C | C | C | C | B | A | A | A | A | A |
| Comparative Example 2 | C | C | C | C | C | B | B | B | C | A | A |
| Comparative Example 3 | C | C | C | C | C | B | B | B | C | A | A |
| Comparative Example 4 | C | C | C | C | C | B | B | B | B | A | A |
| Comparative Example 5 | C | C | C | C | C | B | B | B | B | A | A |
| Comparative Example 6 | C | C | C | C | A | C | A | A | A | A | A |
| Comparative Example 7 | C | C | C | C | C | C | C | B | C | A | A |
| Comparative Example 8 | C | C | C | C | C | C | C | B | C | A | A |
| Comparative Example 9 | C | C | C | C | C | C | C | B | C | A | A |

TABLE 3

| | Film Transferring Method (non-printed portion/ printed portion) | Coating Method (non-printed portion/ printed portion) |
|---|---|---|
| Example 1 | 30/40 | 2.8/1.0 |
| Example 12 | 45/55 | 2.5/1.0 |
| Example 21 | 35/45 | 3.0/1.4 |
| Example 22 | 60/70 | 2.2/0.8 |

Evaluation Means

1. Light Resistance 1

As an exposure test, a magenta color patch on the recording sheet for an ink jet printer was irradiated by UV radiation at 30 kJ/$m^2$ under these conditions (black panel temperature: 63° C.; relative humidity: 50%; radiation power of ultraviolet at 340 nm: 0.35 W/$m^2$), using a xenon whether-ometer (trade name: Ci-5000, produced by Atlas Electric Devices Co.). The light resistance 1 was evaluated by measuring refraction density of the irradiated magenta color patch and the original, using a spectrophotometer (trade name: GRETAG SPM50; produced by Gretag Macbeth Corporation).

Remaining Ratio of Refraction Density

A: cases where the refraction density of the irradiated color patch is more than 90% of the original refraction density B: cases where the refraction density of the irradiated color patch is 80 to 90% of the original refraction density C: cases where the refraction density of the irradiated color patch is less than 80% of the original refraction density Light Resistance 2 (yellow stain prevention of a recording sheet for an ink jet printer)

As an exposure test, the recording sheet for an ink jet printer was irradiated by UV radiation at 30 kJ/$m^2$ under these conditions (black panel temperature: 63° C.; relative humidity: 50%; radiation power of ultraviolet at 340 nm: 0.35 W/$m^2$), using a xenon whether-ometer (trade name: Ci-5000, produced by Atlas Electric Devices Co.). The L*, a* and b* values of the recording sheets after the UV radiation and before the UV radiation were obtained by using a spectrophotometer (trade name: GRETAG SPM50; produced by Gretag Macbeth Corporation). ΔE is defined as the difference between these values of the recording sheets after the UV radiation and before the UV radiation, the degree of the yellow stain was evaluated according to the ΔE value.

Degree of Yellow Stain

A: cases where ΔE is less than 5

B: cases where ΔE is 5 to 10

C: cases where ΔE is more than 10

Light resistance 3

Yellow, magenta, cyan, and black color patches were left near a windowpane facing south for about 1 month. Thereafter, the average of the remaining ratio of the refraction density was obtained by measuring the refraction density of these test color patches and the originals, using a spectrophotometer (trade name: GRETAG SPM50; produced by Gretag Macbeth Corporation), and the light resistance 3 was evaluated according to the following criteria.

Average of Remaining Ratio of Refraction Density

A: cases where the refraction density of the test color patch is more than 90% of the original refraction density B: cases where the refraction density of the test color patch is 80 to 90% of the original refraction density C: cases where the refraction density of the test color patch is less than 80% of the original refraction density Light Resistance 4

Red, green and blue color patches were left near a windowpane facing south for about 1 month. Thereafter, the L*, a* and b* values were obtained by measuring the refraction density of these test color patches and the originals, using a spectrophotometer (trade name: GRETAG SPM50; produced by Gretag Macbeth Corporation). ΔE is defined as the difference between these values of the test color patch and these of the original and ΔEavg is defined as the average of each ΔE, the light resistance 4 was evaluated according to the following criteria.

Average of ΔE

A: cases where ΔEavg is less than 5

B: cases where ΔEavg is 5 to 10

C: cases where ΔEavg is more than 10

2. Shelf-life in a Clear File (yellow stain prevention in clear file)

The recording sheets for an ink jet printer were inserted into a clear file (trade name: CL-A420; produced by MITSUBISHI PENCIL CO., LTD.) so that these sheets protruded from the clear file about 2 cm, and were stored at 60° C. for 2 weeks. Thereafter, the color difference ΔE (CIE L*a*b*) was evaluated by measuring the yellow stain of these test sheets and the originals, using a spectrophotometer (trade name: GRETAG SPM50; produced by Gretag Macbeth Corporation).

Color Difference

A: cases where the color difference is less than 2

B: cases where the color difference is 2 to 5

C: cases where the color difference is more than 5

3. Shelf-life in a Room

The printing images (portraits) on the recording sheet for an ink jet printer were placed on a wall at 2 m from a window facing north, for about 6 months. Thereafter, the shelf-life in the room was evaluated by visual observation of these test sheets and the originals.

Visual Evaluation

A: cases where the change between these test sheets and the originals is not observed B: cases where the change between these test sheets and the originals is observed 4. Water Resistance Letters of yellow, magenta, cyan, red, green, blue, and black printed on the recording sheet for an ink jet printer had one drop of water placed thereon by a syringe, and were air-dried.

Evaluation of Water Resistance

A: cases where the flow of the dye is not observed

B: cases where the flow of the dye is observed, but the letter can be read

C: cases where the letter cannot be read

5. Ink Absorptivity

Images are printed on the recording sheet by an ink jet printer and the ink absorptivity is evaluated by observing multicolor bleeding and unicolor bleeding thereon. The evaluation is performed by comparing the ink absorptivities of genuine glossy papers (trade name: glossy paper for super-fine (thick-type) photoprint paper; produced by Seiko Epson Corporation) by visual observation. In the following, the difference in the SCID image refers to a comparison with respect to high-minuteness Standard Color Image Data (N1 portrait image and N3 fruits basket image of ISO/JIS-SCID according to Japanese Industrial Standard X9201-1995)

Evaluation of Ink Absorptivity

A: cases where the problem in practice use is not observed at all and ink absorptivity is superior (equality or more)

B: cases where the problem in practice use is not observed and ink absorptivity is superior (it is inferior a little, but differences in the SCID image is not observed)

C: cases where ink absorptivity is inferior in practice use (differences in the SCID image is observed)

6. Image Moisture Resistance

Color patches of yellow, magenta, cyan, red, green, blue and black are printed on the recording sheet. The sheet is left under high humidity condition (temperature: 40° C., humidity: 85%) for 3 days and nights, and the image moisture resistance is evaluated by observing color change and bleeding outline of color patches.

Evaluation of Image Moisture Resistance

A: cases where the problem in practice use is not observed at all and image moisture resistance is superior (color change and bleeding outline is not observed at all)

B: cases where the problem in practice use is not observed and image moisture resistance is superior (a few bleeding is observed)

C: cases where image moisture resistance is inferior in practice use

7. Ink Receiving Layer Strength (adhesive property)

As a criteria of productivity (adhesive property to the base material and prevention of powdering of the layer in the cutting process), ink receiving layer strength is evaluated by adhering a cellophane tape on the provided ink receiving layer and tearing it off.

Evaluation of Ink Receiving Layer Strength

A: cases where the productive problem is not observed at all and ink receiving layer strength is superior (nothing is adhered on the cellophane tape)

B: cases where the productive problem is not observed and ink receiving layer strength is superior (a few things are adhered on the cellophane tape, but the ink receiving layer is not broken)

C: cases where the productive problem is observed (the ink receiving layer is broken and tears off)

8. Glossiness Adjusting Layer Strength (adhesive property)

As a criteria of productivity (adhesive property to the base material and prevention of powdering of the layer in the cutting process), glossiness adjusting layer strength is evaluated by adhering a cellophane tape on the provided glossiness adjusting layer and tearing it off.

Evaluation of Glossiness Adjusting Layer Strength

A: cases where the productive problem is not observed at all and glossiness adjusting layer strength is superior (nothing is adhered on the cellophane tape)

B: cases where the productive problem is not observed and glossiness adjusting layer strength is superior (a few things are adhered on the cellophane tape, but the glossiness adjusting layer is not broken)

C: cases where the productive problem is observed (the glossiness adjusting layer is broken and tears off)

9. 60° Specular Glossiness

With respect to the recording sheets according to Example 1, 12, 21 and 22 produced by the film transferring method and the coating method, the 60° specular glossiness according to the measuring method of Japanese Industrial Standard Z8741, is measured.

As is apparent from the results of the above tests, the recording sheets for an ink jet printer according to Examples 1 to 25 showed that essential requirements such as printing density, vividness, and ink absorptivity are very superior, and further excellent properties were obtained in light resistance, which particularly avoided fading and changing of color tone in direct sunlight; shelf-life in a room; and water resistance. It was confirmed that this recording sheet for an ink jet printer scarcely causes yellow stain in long-term preservation. By comparing the glossiness adjusting layers in Example 1, 12, 21 and 22, it was shown that the glossiness can be optionally adjusted. However, no improvement was observed in the Comparative Examples 1 to 9 with respect to light resistance, and ink absoptivity and water resistance were inferior.

In addition to the above-described Examples, the recording sheets for an ink jet printer employed halogenides or hexafluorosilicates of typical metallic elements such as magnesium, calcium, strontium, barium, gallium, indium, thallium, germanium, tin, lead, bismuth, or the like; water-soluble salts such as sulfate, thiosulfate, phosphate, chlorate, nitrate, or the like instead of the magnesium chloride in Example 1, were confirmed to have the same effects.

As explained above, according to the present invention, characterized by including water-soluble divalent or greater metallic salt, a new recording sheet for an ink jet printer having properties in that printing density is high and vivid; ink absorptivity and shelf-life in a room are superior; and light resistance which can particularly avoid fading and changing of color tone in direct sunlight and in which yellow stain prevention and water resistance are excellent, can be provided. Furthermore, since ink is quickly absorbed, these also have properties which satisfy high speed printing techniques.

What is claimed is:

1. A recording sheet for an ink jet printer comprising an ink receiving layer consisting of at least one pigment and at least one binder resin disposed on a base material, said ink receiving layer including a water-soluble divalent or greater metallic salt; and a glossiness adjusting layer provided on the surface of said ink receiving layer.

2. A recording sheet for an inkjet printer in accordance with claim 1 wherein said water-soluble divalent or greater metallic salt comprises 5.0% to 40.0% by weight, based on the total weight of said ink receiving layer.

3. A recording sheet for an inkjet printer in accordance with claim 1 wherein said water-soluble divalent or greater metallic salt comprises a metallic element of the Periodic Table of the Elements.

4. A recording sheet for an ink jet printer in accordance with claim 1 wherein said water-soluble divalent or greater metallic salt is selected from the group consisting of magnesium chloride, magnesium sulfate and calcium chloride.

5. A recording sheet for an ink jet printer in accordance with claim 1 wherein said pigment is selected from the group consisting of silica, alumina and mixtures thereof.

6. A recording sheet for an ink jet printer in accordance with claim 1 wherein said binder resin includes polyvinyl alcohol as a component.

7. A recording sheet for an ink jet printer in accordance with claim 1 wherein said ink receiving layer includes a cationic component.

8. A recording sheet for an ink jet printer in accordance with claim 7 wherein said cationic component comprises 1.0% to 20.0% by weight, based on the total weight of said ink receiving layer.

9. A recording sheet for an ink jet printer in accordance with claim 7 wherein said ink receiving layer includes 1.0% to 40.0% by weight of said water-soluble divalent or greater metallic salt, based on the total weight of said ink receiving layer.

10. A recording sheet for an ink jet printer in accordance with claim 7 wherein said ink receiving layer includes 0.2 $g/m^2$ to 10.0 $g/m^2$ of said water-soluble divalent or greater metallic salt.

11. A recording sheet for an ink jet printer in accordance with claim 7 wherein said ink receiving layer includes 40.0% to 60.0% by weight of said pigment, 20.0% to 40.0% by weight of said binder resin and 1.0% to 40.0% by weight of said water-soluble divalent or greater metallic salt by weight, said percentages being by weight, based on the total weight of said ink receiving layer.

12. A recording sheet for an ink jet printer in accordance with claim 7 wherein said glossiness adjusting layer includes colloidal silica.

13. A recording sheet for an ink jet printer in accordance with claim 7 wherein said glossiness adjusting layer has a 60° specular glossiness of 10 or more.

14. A recording layer for an ink jet printer in accordance with claim 1 herein said ink receiving layer includes 1.0% to 40.0%by weight of said water-soluble divalent or greater metallic salt, based on the total weight of said ink receiving layer.

15. A recording sheet for an inkjet printer in accordance with claim 1 wherein said ink receiving layer includes 0.2 $g/m^2$ to 10.0 $g/m^2$ of said water-soluble divalent or greater metallic salt.

16. A recording sheet for an ink jet printer in accordance with claim 1 wherein said ink receiving layer includes 40.0% to 60.0% by weight of said pigment, 20.0% to 40.0% by weight of said binder resin and 1.0% to 40.0% by weight of said water-soluble divalent or greater metallic salt by weight, said percentages being by weight, based on the total weight of said ink receiving layer.

17. A recording sheet for an ink jet printer in accordance with claim 1 wherein said glossiness adjusting layer includes colloidal silica.

18. A recording sheet for an ink jet printer in accordance with claim 1 wherein said glossiness adjusting layer has a 60° specular glossiness of 10 or more.

* * * * *